US011598043B2

(12) United States Patent
Cangiano et al.

(10) Patent No.: US 11,598,043 B2
(45) Date of Patent: Mar. 7, 2023

(54) VERTICAL AXIS WASHER STANDALONE FILTER

(71) Applicant: WHIRLPOOL CORPORATION, Benton Harbor, MI (US)

(72) Inventors: Ricardo S. Cangiano, Rio Claro (BR); Sagar Kumar, Pune (IN); Sadasivam Narayanan, Salem (IN); Aliander Filgueiras da Silva, Rio Claro (BR)

(73) Assignee: Whirlpool Corporation, Benton Harbor, MI (US)

( * ) Notice: Subject to any disclaimer, the term of this patent is extended or adjusted under 35 U.S.C. 154(b) by 86 days.

(21) Appl. No.: 17/179,095

(22) Filed: Feb. 18, 2021

(65) Prior Publication Data

US 2022/0259793 A1 Aug. 18, 2022

(51) Int. Cl.
*D06F 39/10* (2006.01)
*D06F 23/04* (2006.01)

(52) U.S. Cl.
CPC ..... *D06F 39/10* (2013.01); *D06F 23/04* (2013.01)

(58) Field of Classification Search
CPC ..... D06F 39/10; D06F 23/04
USPC ..... 68/18 f
See application file for complete search history.

(56) References Cited

U.S. PATENT DOCUMENTS

| | | | |
|---|---|---|---|
| 8,601,836 | B2 | 12/2013 | Kim et al. |
| 2008/0217243 | A1 | 9/2008 | Yoo et al. |

FOREIGN PATENT DOCUMENTS

| | | | | |
|---|---|---|---|---|
| BR | 102012030892 | A2 | * | 9/2014 |
| JP | 2010012143 | A | * | 1/2010 |
| JP | 2013141553 | A | * | 7/2013 |
| KR | 20180074910 | A | | 7/2018 |
| WO | 2017073120 | A1 | | 5/2017 |
| WO | 2018030718 | A1 | | 2/2018 |

OTHER PUBLICATIONS

JP2010012143A—Machine translation (Year: 2010).*
JP2013141553A—Machine translation (Year: 2013).*
BR102012030892A2—Machine translation (Year: 2012).*

* cited by examiner

*Primary Examiner* — Tinsae B Ayalew
(74) *Attorney, Agent, or Firm* — Brooks Kushman P.C.

(57) ABSTRACT

A standalone drum-mounted lint filter for a washing machine is provided. The filter includes a filter housing including a plurality of inner walls dividing the filter housing into a plurality of filter chambers, each filter chamber defining at least one inlet configured to allow wash water to flow into the respective chamber. The filter further includes at least one retainer barrel arranged within each filter chamber and configured to retain lint during operation of the washing machine. The filter also includes a porous removable filter cover defining front-facing outlets open to the drum, allowing for exit of the wash water back into the wash.

27 Claims, 9 Drawing Sheets

VERTICAL AXIS WASHER STANDALONE FILTER

TECHNICAL FIELD

The present disclosure relates to a standalone filter for use in vertical axis washing machines.

BACKGROUND

Lint filters are used in washing machines to capture lint on laundry loads after a wash cycle. The captured lint is retained inside the filter, allowing the consumer to clean the filter after a wash cycle is completed. For customers who do not use clothes drying appliances, it is especially important to trap lint during the wash cycle.

SUMMARY

In one or more illustrative examples, a standalone drum-mounted lint filter for a washing machine is provided. The filter includes a filter housing having a plurality of inner walls dividing the filter housing into a plurality of filter chambers, each filter chamber defining at least one inlet configured to allow wash water to flow into the respective chamber. The filter further includes at least one retainer barrel arranged within each filter chamber and configured to retain lint during operation of the washing machine. The filter also includes a porous removable filter cover defining front-facing outlets open to the drum, allowing exit of the wash water back into the wash.

In one or more illustrative examples, a laundry appliance is provided. The laundry appliance includes a drum, and a standalone lint filter mounted to an internal side wall of the drum. The lint filter includes a plurality of chambers, each chamber having a lateral inlet and an outlet open towards the interior of the drum. The lint filter further includes a removable porous cover to which a plurality of retainer barrels are mounted, such that when the cover is attached to the lint filter the retainer barrels fit into the plurality of chambers to trap lint, and when the cover is detached from the lint filter the retainer barrels allow for cleaning.

DETAILED DESCRIPTION

Figure 1:
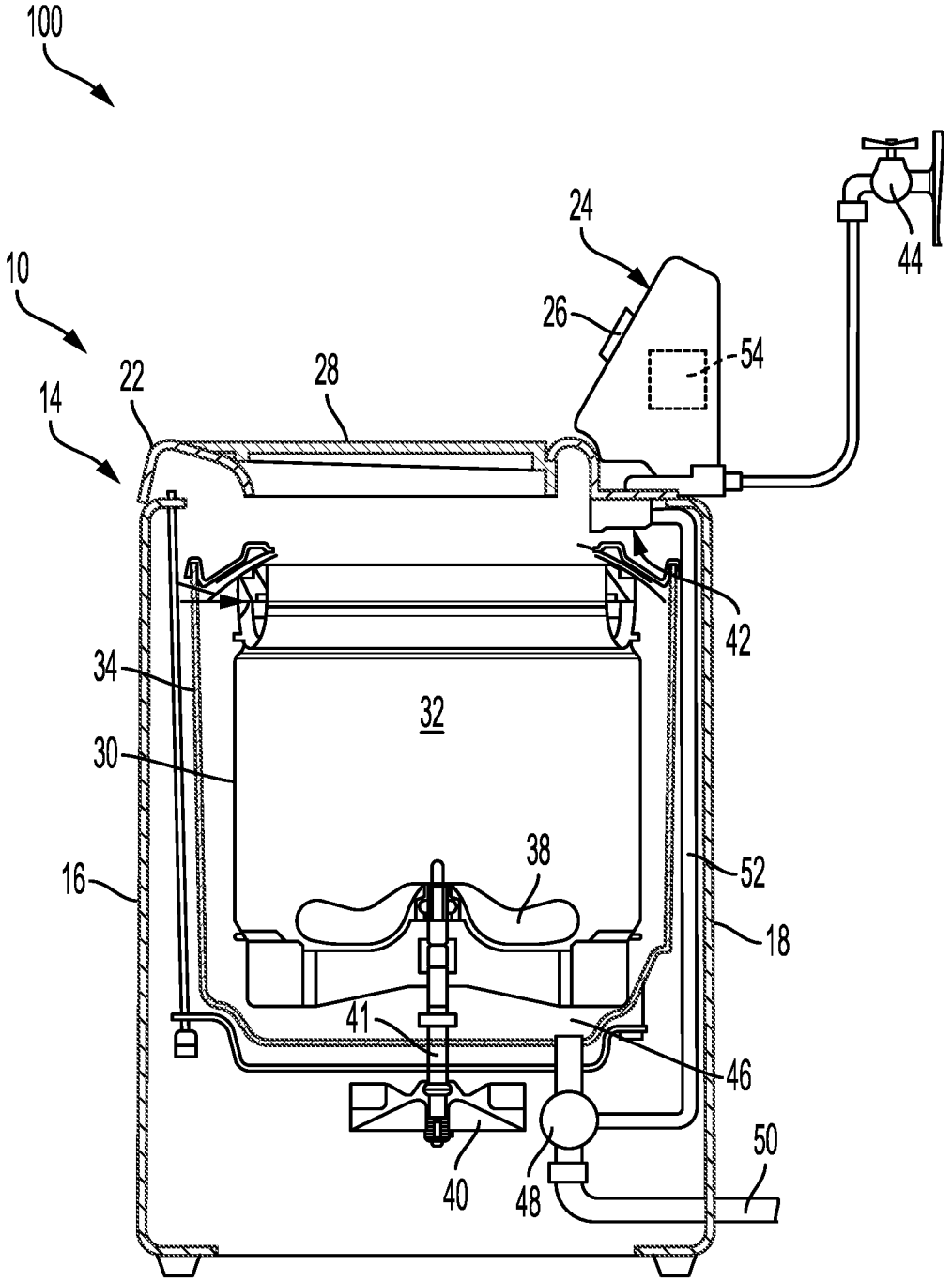
FIG. 1 illustrates a simplified laundry treating appliance having a standalone filter in a drum located within a tub.

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Many washing machines use a pumping tower mechanism to generate water flow through a lint filter. In such a design, a conduit connects an input at the bottom of the washing machine to an outlet on the side of the drum facing into the wash. A filter mechanism fits into the outlet. As the drum rotates, fluid travels into the pumping tower inlet because of the rotational force exerted by the drum and exits the outlet into the filter. When the wash cycle is complete, the filter may be removed from the outlet and cleaned or replaced. While effective, these filtration systems are complex and involve many parts. Moreover, assembly of pumping tower filtration systems is labor-intensive and involves multiple line operators to build.

An improved washing machine filter is disclosed herein. The improved filter is standalone, meaning that the filter does not require a pumping tower mechanism to generate water flow into the filter. Instead, the filter utilizes a multiple-way inlet design, in combination with a chambered construction that eliminates the possibility of liquid from one chamber escaping through the other. The internal geometry of the filter is defined with a profile that directs the fluid from inlets to corresponding outlets to improve filter efficiency. An example design has a combination of side and bottom inlets. The side inlets have multiple chambers with angular guide ribs that direct the fluid flow towards the outlets without any backflow or losses due to gravitational action. Retainer barrels forming a cylindrical array of retention pins are provided in the chambers to trap lint and retain it during the wash cycle.

These features in combination allow the standalone filter to deliver better performance in terms of trapping lint compared to pumping tower designs. Moreover, as the filter may be manufactured as a simple one-piece construction (or a two-piece construction with an overmolded mesh), the filter can be produced using fewer and less-expensive parts, thereby providing for efficient assembly by fewer line operators.

FIG. 1 is a simplified view of a laundry treating appliance 10 configured to utilize a standalone filter 56. The laundry treating appliance 10 may be any machine that treats articles such as clothing or fabrics. Examples of the laundry treating appliance 10 may include, but are not limited to, a vertical axis washing machine; a vertical axis dryer (such as a tumble dryer or a stationary dryer), a tumbling or stationary refreshing/revitalizing machine, an extractor, a non-aqueous washing apparatus, and a revitalizing machine. As used herein, the term "vertical-axis" washing machine refers to a washing machine having a rotatable drum that rotates about a generally vertical axis relative to a surface that supports the washing machine. However, the rotational axis need not be perfectly vertical to the surface. For example, the drum may rotate about an axis inclined relative to the vertical axis (e.g., with fifteen degrees of inclination being one example of the inclination).

As illustrated in FIG. 1, the laundry treating appliance 10 includes a cabinet 14 defined by a front wall 16, a rear wall 18, a pair of side walls (not shown) and supporting a top wall 22. A user interface 24 on the cabinet 14 may have multiple controls 26, which may be used to select a cycle of operation. A chassis (not shown) may be provided, with the walls mounted to the chassis.

The top wall 22 may have an openable lid or door 28 and may be selectively moveable between opened and closed positions to close an opening in the top wall 22. In the opened position, the door 28 provides access to the interior of the cabinet 14. A rotatable drum 30 is disposed within the interior of the cabinet 14 and defines a treating chamber 32 for treating laundry. The drum 30 may be positioned within an imperforate tub 34. The drum 30 itself may include a plurality of perforations (not shown), such that liquid may flow between the tub 34 and the drum 30 through the perforations. A clothes mover 38 may be located in the drum 30 to impart mechanical agitation to a load of clothing articles placed in the drum 30.

The drum 30 and/or the clothes mover 38 may be driven by an electrical motor 40 operably connected to the drum 30 and/or the clothes mover 38 by a drive shaft 41. The clothes mover 38 may be oscillated or rotated about its axis of rotation during a cycle of operation in order to produce high water turbulence effective to wash the load contained within the treating chamber 32. The motor 40 may rotate the drum 30 at various speeds in either rotational direction.

A liquid supply and recirculation system 42 may be provided to spray treating liquid, such as water or a combination of water and one or more wash aids, such as detergent, into the open top of the drum 30 and onto the top of a laundry load placed within the treating chamber 32. The liquid supply and recirculation system 42 may be configured to supply treating liquid directly from a household water supply 44 and/or from the tub 34 and spray it onto the fabric load. The liquid supply and recirculation system 42 may also be configured to recirculate treating liquid from the tub 34, including a sump 46, and spray it onto the top of the load. A pump 48 may be housed below the tub 34. The pump 48 may have an inlet fluidly coupled to the sump 46 and an outlet configured to fluidly couple to either or both a household drain 50 or a recirculation conduit 52. In this configuration, the pump 48 may be used to drain or recirculate wash water in the sump 46, which is initially sprayed into the drum 30, flows through the drum 30, and then into the sump 46.

The laundry treating appliance 10 may further comprise a controller 54 coupled to various working components of the laundry treating appliance 10, such as the motor 40 and the pump 48, to control the operation of the working components. The user interface 24 may be coupled to the controller 54 and may provide for input/output to/from the controller 54. In other words, the user interface 24 may allow a user to enter input related to the operation of the laundry treating appliance 10, such as selection and/or modification of an operation cycle of the laundry treating appliance 10, and receive output related to the operation of the laundry treating appliance 10. Examples, without limitation, of cycles of operation include: wash, heavy duty wash, delicate wash, quick wash, refresh, rinse only, and timed wash. Any suitable controller 54 may be used. The specific type of controller is not germane to the invention. It is contemplated that the controller 54 may be a microprocessor-based controller that implements control software and sends/receives one or more electrical signals to/from each of the various components to affect the control software. As an example, proportional control (P), proportional integral control (PI), and proportional derivative control (PD), or a combination thereof, a proportional integral derivative control (PID control), may be used to control the various components.

Figure 2:
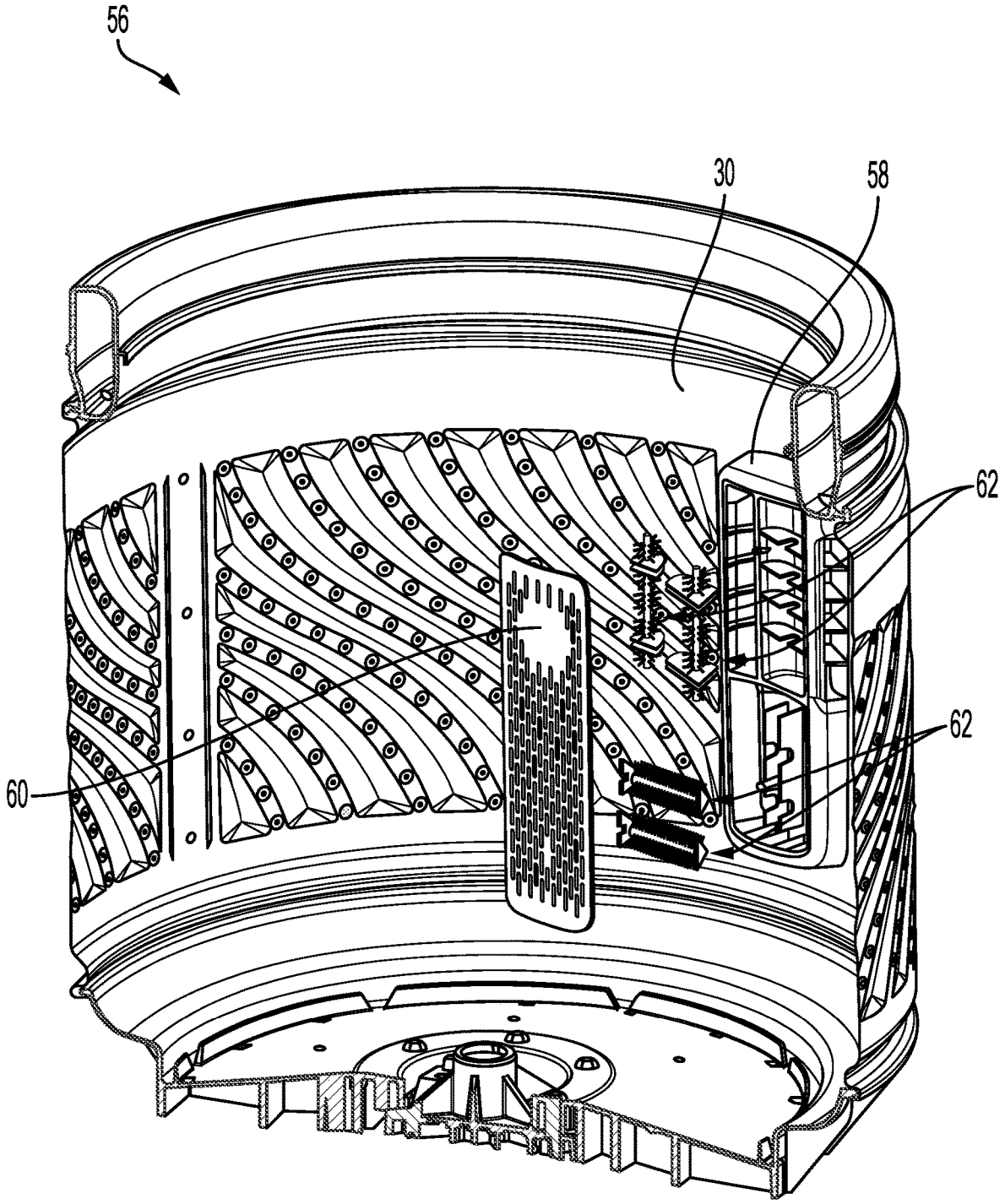
FIG. 2 illustrates a cutaway perspective view of the drum illustrating placement of the standalone filter.

FIG. 2 illustrates a cutaway view of the drum 30 illustrating placement of the standalone filter 56. The standalone filter 56 is shown in exploded view. As illustrated, the filter 56 generally includes a filter housing 58, a filter cover 60, and a plurality of retainer barrels 62.

The filter housing 58 is configured to be fastened to the drum 30. In an example, the filter housing 58 may snap into a connector on the drum 30 interior, by way of molded snap fasteners. In another example, the filter housing 58 may be fixed to the drum 30 by way of screws, pins, rivets, glue, or another fastener. In yet a further example, the filter housing 58 may be integral to the drum.

The filter cover 60 is configured to be selectively attached to the filter housing 58 during machine operation, and removable after wash operation to clean the filter 56. The filter cover 60 may be porous to allow for the free flow of water, although the specific pattern of openings is immaterial and may vary. In an example, the filter cover 60 may be composed, at least in part, of a nylon mesh overmolded to a base panel. In another example, the filter cover 60 may be a single piece, without the nylon mesh. In one example, the filter cover 60 may be attached to the filter housing 58 by snaps. In another example, the filter cover 60 may be screwed into the filter housing 58.

Figure 3:
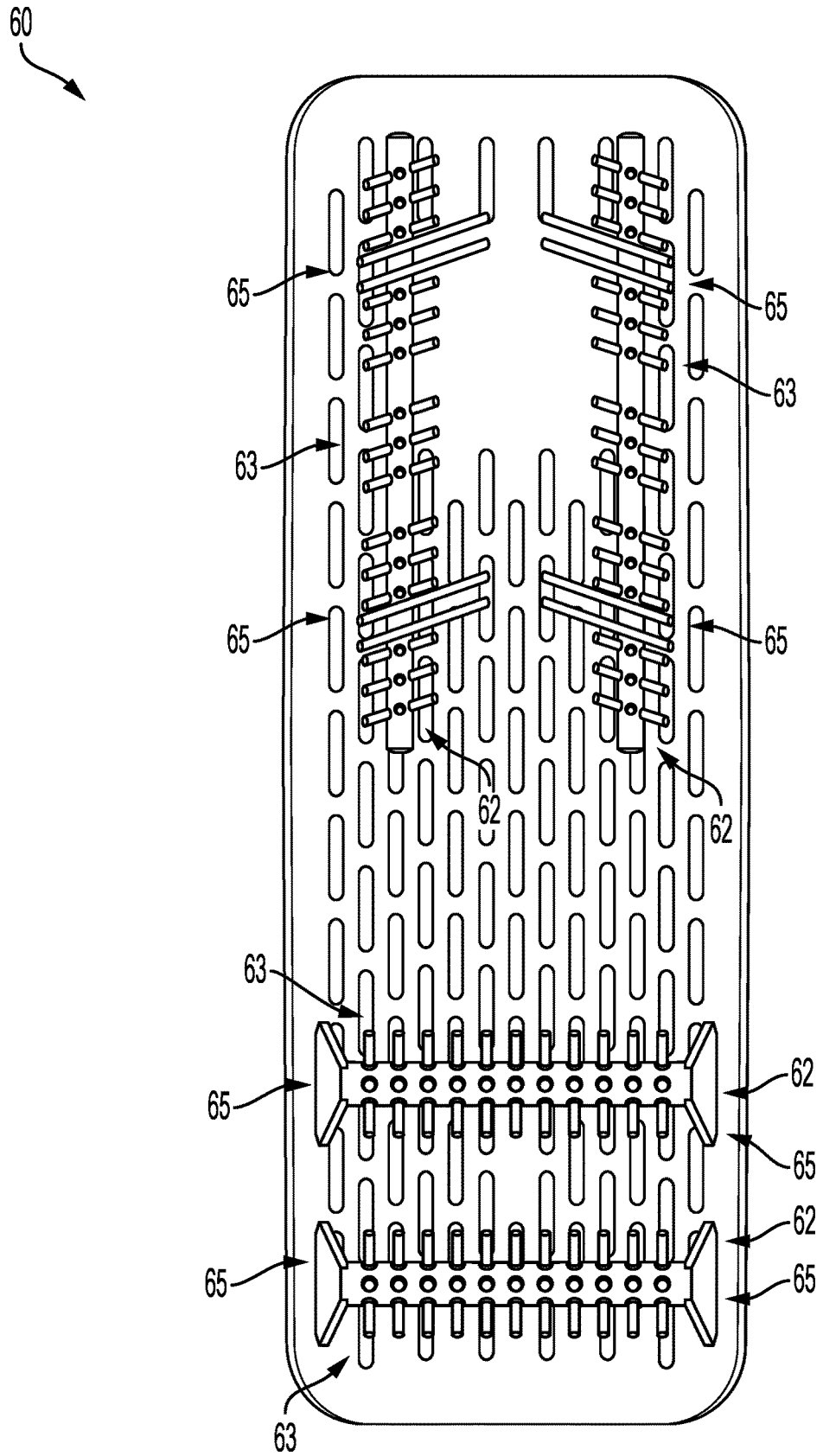
FIG. 3 illustrates a front view of a cover of the filter with the retainer barrels attached to the filter cover.
Figure 4:
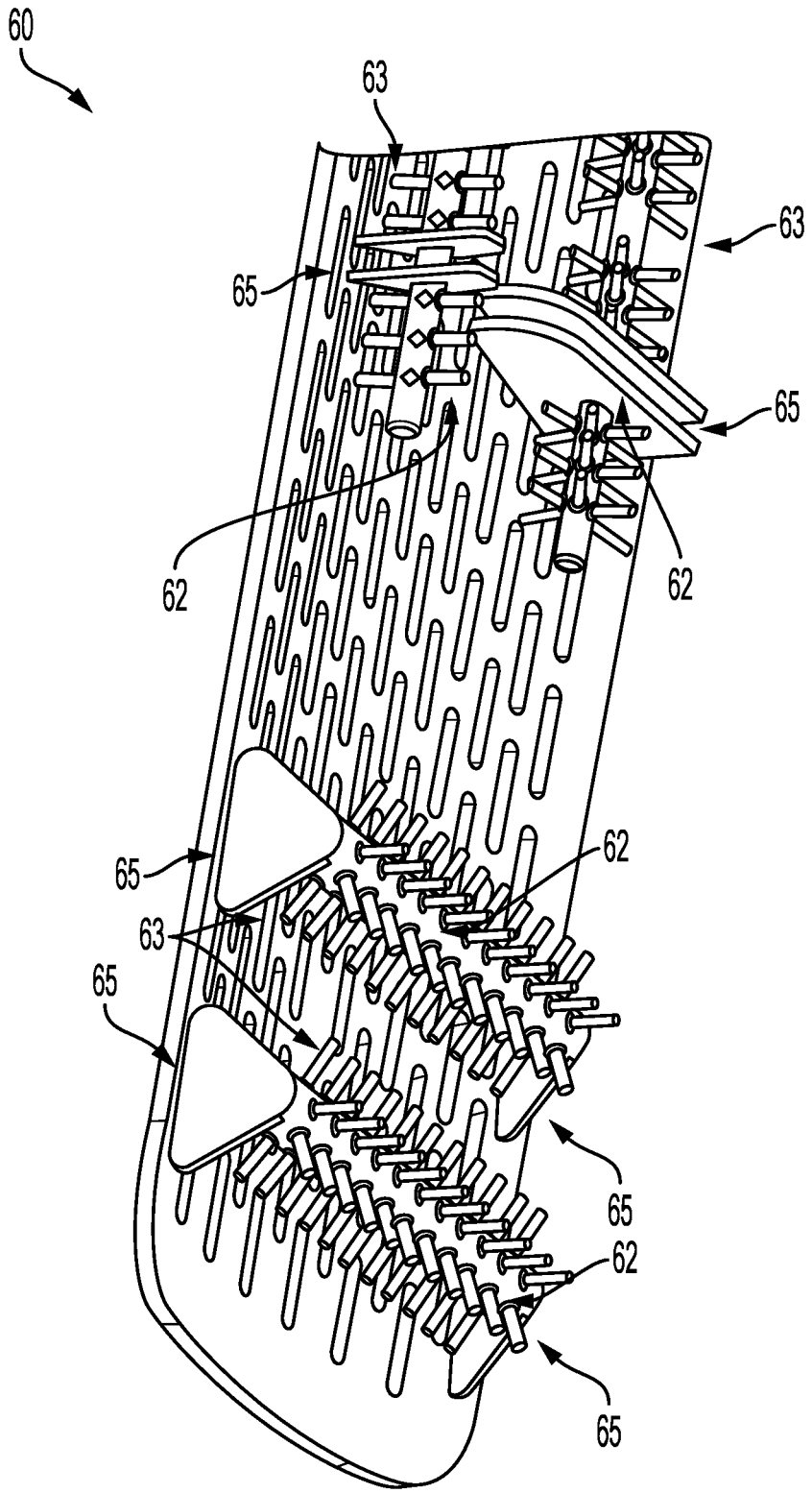
FIG. 4 illustrates a partial perspective view of the cover of FIG. 3.
Figure 8:
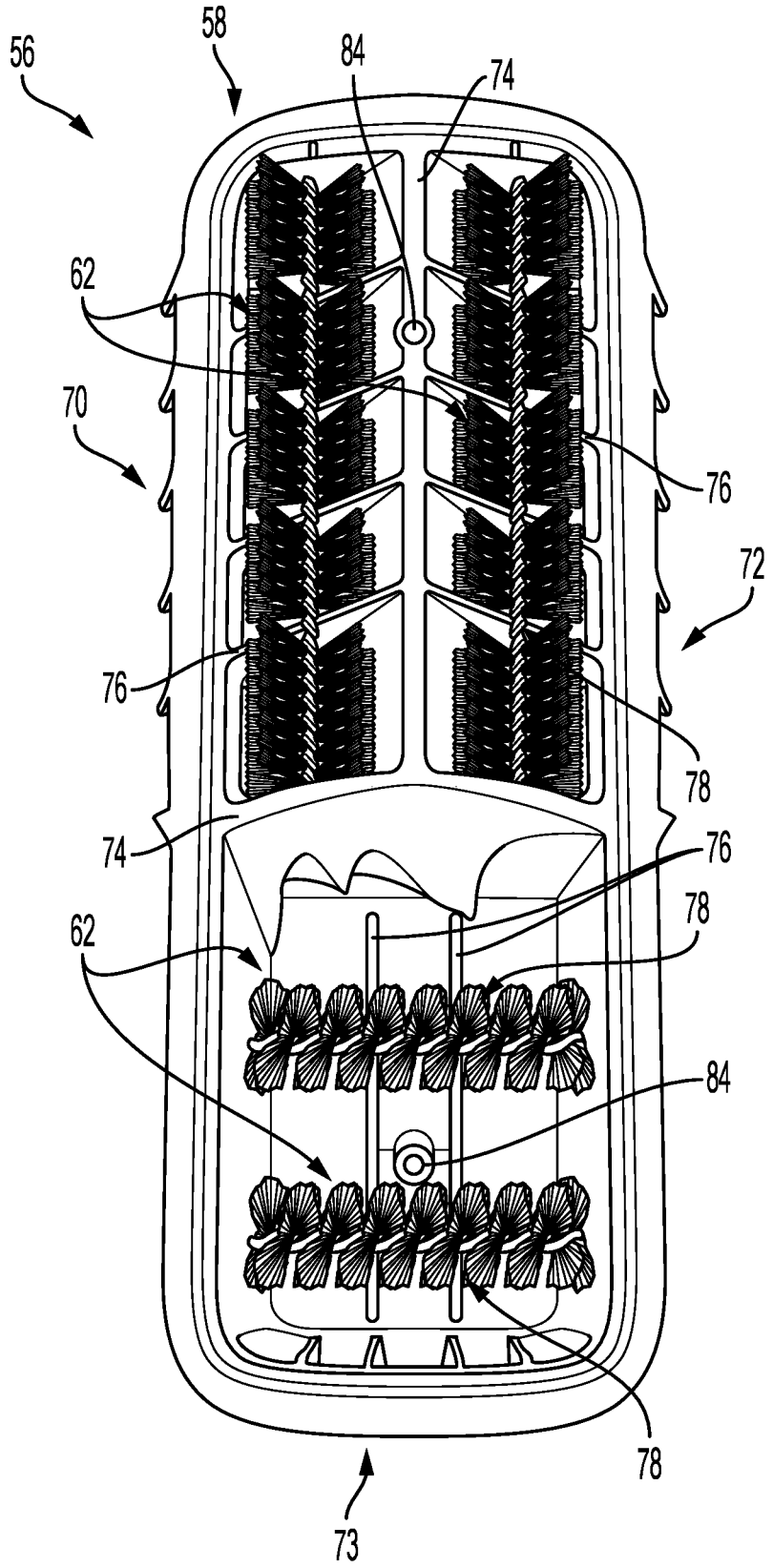
FIG. 8 illustrates an example standalone filter utilizing brush filter elements.
Figure 9:
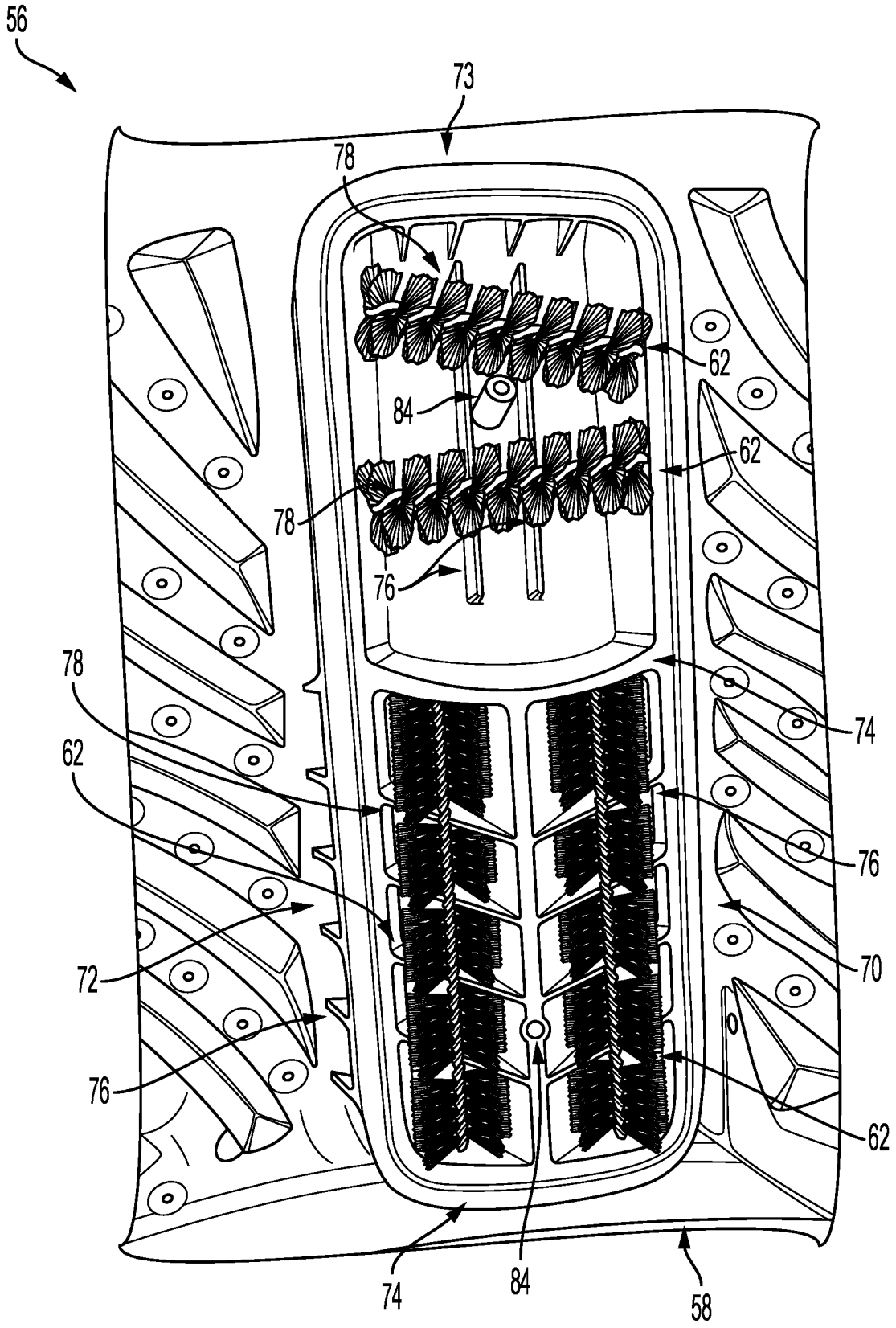
FIG. 9 illustrates an alternate orientation of the standalone filter of FIG. 8.

The retainer barrels 62, as further illustrated in FIGS. 3 and 4, may be formed of a rod or barrel having groupings of pins 63 that extend radially outward along the circumference of the barrel. In an example, the pins 63 may be formed into groups of equally spaced pins 63 along the length of the barrel. In another example, the pins 63 may be arranged unequally, such as randomly, staggered or in another formation. As shown, groupings of six pins 63 are used, but radial groupings of more or fewer pins 63 are possible. In many cases, the pins 63 may be of substantially equivalent length to one another to form a cylindrical area for the catching of lint. The pins 63 may be formed as unitary, semi-rigid bristles in some examples. In other examples, the pins 63 may be formed of groups of smaller bristles. For instance, as shown in FIGS. 8 and 9, the pins 63 are formed as a pipe cleaner, with tufts of brussels intertwined with a twisted wire core.

FIGS. 3 and 4 illustrate the cover 60 having the barrels 62 attached thereto. As shown, the retainer barrels 62 may be mounted to the filter cover 60 such that removal of the filter cover 60 from the filter housing 58 provides for access to the retainer barrels 62 for cleaning. The retainer barrels 62 may be attached to the filter cover 60 using barrel supports 65. The barrels 62 may be mounted via the barrel supports 65 to provide for free rotation about the axis of the barrels 62, thereby allowing the pins 63 to rotate in the water flow. In other examples, the barrels 62 may be fixed and not rotatable, and may therefore remain stationary during the water flow. It should be noted that this is only one example, and in other examples the barrels 62 may be supported by other features or may be an integral part of the cover 60.

Figure 5:
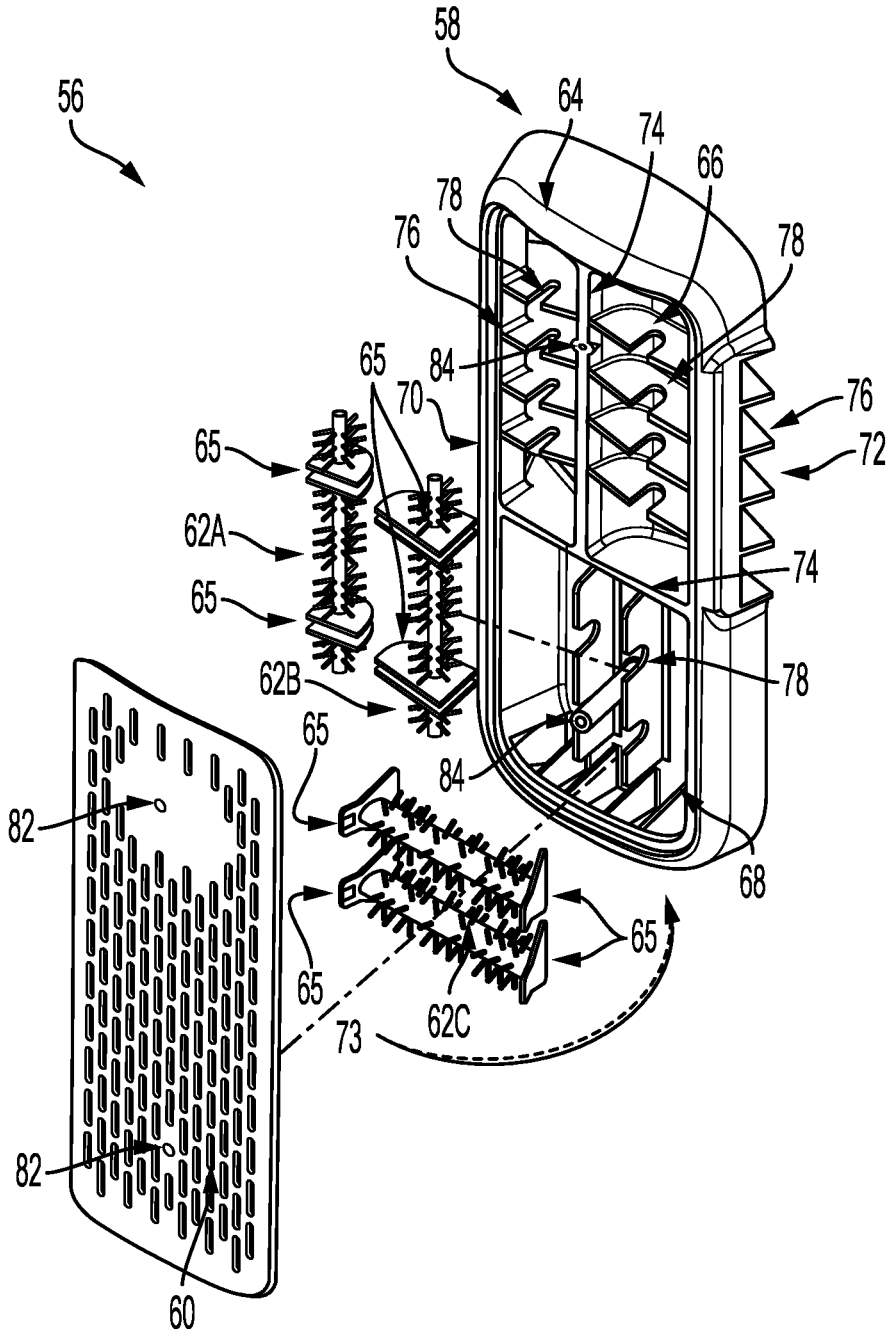
FIG. 5 illustrates an exploded isometric view of the components of the standalone filter.

FIG. 5 illustrates an exploded isometric view of the components of the standalone filter 56. As illustrated, the filter housing 58 of the standalone filter 56 defines a plurality of chambers, including a top left, or first chamber 64, a top right, or second chamber 66, and a bottom, or third chamber 68. The first and second chambers 64, 66 may be arranged adjacent to one another above the third chamber 68. Each of the chambers 64, 66, 68 has a corresponding inlet along a respective side of the filter housing 58 into which water may pass into the filter housing 58. A left side, or first inlet 70 allows for water to flow laterally into the top left chamber 64. A right side, or second inlet 72 allows for water to flow laterally into the top right chamber 66. A bottom, or third inlet 73 allows for water to flow upward into the bottom chamber 68.

The plurality of chambers 64, 66, 68 may be designed to allow the filter 56 to handle different load sizes (e.g., small, medium, large, and extra large loads). Depending upon the load size, the utilization of the chambers 64, 66, 68 may vary. For example for a 1.5 Kg load size, the bottom chamber 68 may be fully utilized, although the side inlet chambers may perform no or only a minimal role, but for a 8 Kg load, the bottom chamber 64 and both side inlet chambers 64, 66 may be utilized.

Figure 6:
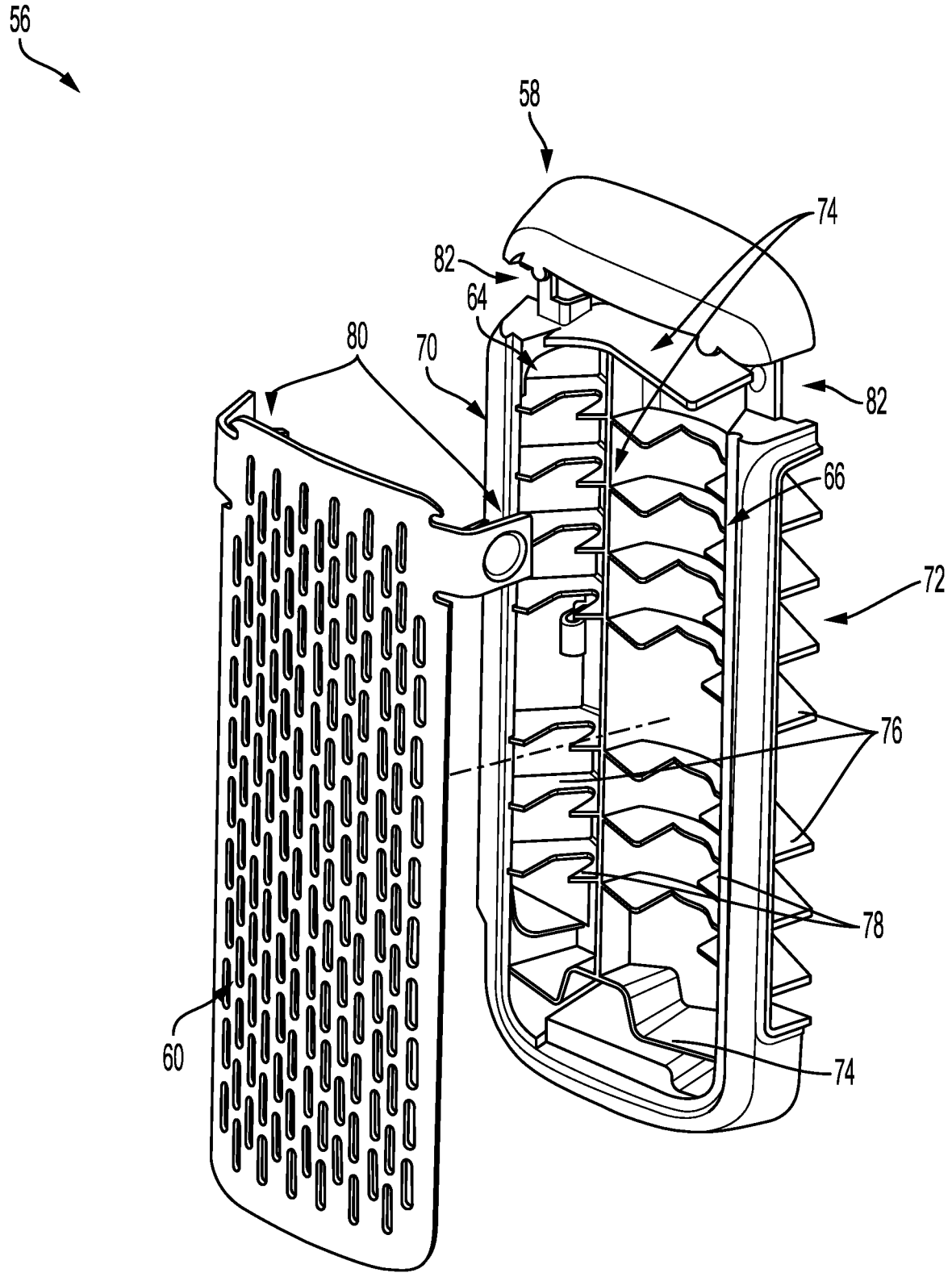
FIG. 6 illustrates an exploded isometric view of alternate standalone filter.

It should be noted that the illustrated arrangement of chambers 64, 66, 68 is only one example, and other arrangements of chambers 64, 66, 68 may be used. For instance, as shown in FIG. 6, an alternate standalone filter 56 is provided having side chambers 64, 66 only, without also a bottom chamber 68. Or, as shown in FIG. 9, an alternate standalone filter 56 is provided having the bottom chamber 68 above the side chambers 64, 66.

With reference to FIG. 5, one or multiple retainer barrels 62 may be arranged on the cover 60 are various locations such that in the assembled state, each of the chambers 64, 66, 68 receive at least one of the barrels 62. For instance, in the illustrated example a left, or first retainer barrel 62A is included in the top left chamber 64, a right, or second retainer barrel 62B is included in the top right chamber 66, and multiple bottom, or third retainer barrels 62C are included in the bottom chamber 66. The orientation of the retainer barrels 62A-C may be placed normal to the fluid flow direction in the respective chambers 64, 66, 68 to aid in the trapping of lint or other particles in the water flow. That is, the water flow may be transverse across the retainer barrels 62A-C to allow the water flow to run across and become caught by the pins 63. This arrangement of the pins 63 with respect to the water flow direction increases the probability of lint being trapped by the filter 56. It should be noted that the number and orientation of retainer barrels 62A-C may vary, and more, fewer, and differently oriented retainer barrels 62 may be used.

In some examples, the internal volume of the filter housing 58 may be divided such that the two top chambers 64, 66 collectively hold approximately the same volume of water as the bottom chamber 68. In such an example, the larger bottom chamber 68 may logically include a greater quantity of retainer barrels 62 as compared to the side chambers 64, 66. For instance, in the example as shown each of the side chambers 64, 66 includes one retainer barrel 62, while the larger bottom chamber 68 includes two retainer barrels 62.

The side inlets 70, 72 and side chambers 64, 66 may be split into multiple chambers to reduce the possibility of fluid loss and prevent cross flow between the chambers 64, 66, 68. These chambers 64, 66, 68 may be defined by internal walls 74 that extend from the back of the filter housing 58 forward up to the location of the filter cover 60. As shown a vertical internal wall 74 separates the first chamber 64 from the second chamber 66. Also as shown, a horizontal internal wall 74 separates the first and second chambers 64, 66 from the third chamber 68 below.

Additionally, vanes or ribs 76 may be included in the chambers 64, 66 extending from the inlets 70, 72 along the flow direction to direct the water flow across the pins 63 of the retainer barrels 62A-B and out the filter cover 60. In some examples, the ribs 76 of the side inlets 70, 72 may be angled upward along the water flow direction to counteract the effect of gravity on the water flow. It should be noted that this is only an example, and in other implementations the ribs may be angled in other directions such as downward or even horizontally. Additionally, ribs 76 may be provided vertically upward from the inlet 73 to orient the water flow upward and out the filter cover 60. As the ribs 76 may extend towards the filter cover 60 to a level at or near the interior face of the filter cover 60, the ribs 76 may include notches 78 to provide spacing for the retainer barrels 62 within the chambers 64, 66, 68. For instance, the ribs 76 in the first chamber 64 may define a vertical series of notches 78 into which the vertically-oriented first retainer barrel 62A may fit when the filter cover 60 is attached. Similarly, the ribs 76 in the second chamber 66 may define a vertical series of notches 78 into which the vertically-oriented second retainer barrel 62B may fit when the filter cover 60 is attached. Additionally, the barrel supports 65 for the first and second rainier barrels 62A, 62B may be slotted to fit around the ribs 76 in the first and second chamber 64, 66. Moreover, as shown in the bottom chamber 68, two horizontal rows of notches 78 are defined to allow for placement of the two retainer barrels 62C within the water flow of the bottom chamber 68 when the filter cover 60 is attached.

The filter cover 60 may include one or more openings 82 into which screws or other fasteners may be inserted to fix the filter cover 60 to the filter housing 58. The filter housing 58 may further include corresponding openings 84 aligned with the openings 82 to receive the screws or other fasteners. In the illustrated example an upper opening 84 is integrated into the vertical internal wall 74 separating the first chamber 64 from the second chamber 66, while a lower opening 82 is formed as a standoff extending from the back face of the filter housing 58.

Figure 7:
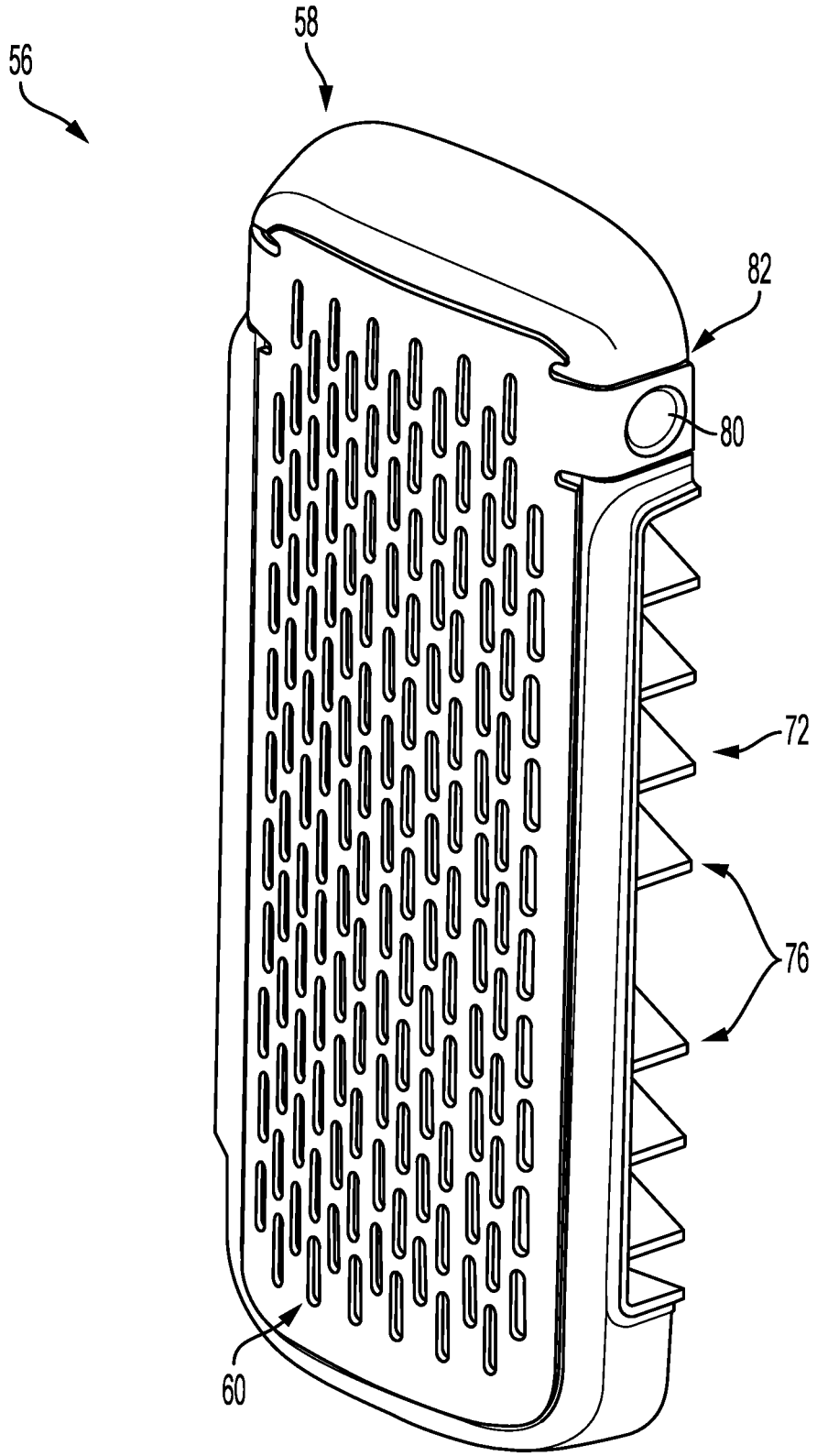
FIG. 7 illustrates an assembled isometric view of the alternate standalone filter of FIG. 6.

Referring to FIGS. 6 and 7, an alternate example filter cover 60 is shown having snap attachment as opposed to screw attachment. As best seen in FIG. 6, the filter cover 60 has snaps 80 that fit into openings 82 of the housing 58. To remove the filter cover 60, the user may press the snaps 80 in to release the snaps 80 from the housing 58. To replace the filter cover 60, the user may push the filter cover back 60 into place onto the housing 58, allowing the snaps 80 to engage with the filter housing 58.

Referring back to FIG. 5, during operation, water enters the left inlet 70 into the top left chambers 64 during counterclockwise motion of the clothes mover 38 and enters the right inlet 72 into the top right chambers 66 during clockwise rotation of the clothes mover 38. Fluid enters from the bottom inlet 73 into the bottom chambers 68 during both clockwise and counterclockwise rotation of the clothes mover 38. Once in the chambers 64, 66, and 68, the water passes through the retainer barrels 62A-C and out the filter cover 60. Lint in the water flow is trapped by the pins 63 of the retainer barrels 62 and retained during the wash cycle. After the wash is complete, the filter cover 60 may be removed, and the retainer barrels 62A-C may be cleaned. The filter cover 60 may then be replaced into the filter housing 58 for additional washes.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

What is claimed is:

1. A standalone drum-mounted lint filter for a washing machine, comprising:

a filter housing including a plurality of inner walls dividing the filter housing into a plurality of filter chambers, each filter chamber defining at least one inlet configured to allow wash water to flow into the respective chamber;

at least one retainer barrel arranged within each filter chamber and configured to retain lint during operation of the washing machine;

a porous removable filter cover defining front-facing outlets open to a washing drum, allowing for exit of the wash water back into the wash; and a plurality of ribs arranged in the plurality of filter chambers along the water flow direction to direct the water flow across the at least one retainer barrel and out the filter cover.

2. The lint filter of claim 1, wherein each retainer barrel includes a cylindrical array of pins configured to trap lint.

3. The lint filter of claim 2, wherein the cylindrical array of pins includes a plurality of radial groupings of pins.

4. The lint filter of claim 2, wherein the retainer barrels are attached to the removable cover to rotate freely.

5. The lint filter of claim 2, wherein the retainer barrels are attached to the removable cover to be stationary with respect to the removable cover.

6. The lint filter of claim 1, wherein each retainer barrel includes bristles configured to trap lint.

7. The lint filter of claim 1, wherein each retainer barrel is arranged normal to the water flow received by the inlet of the respective chamber within the filter housing.

8. The lint filter of claim 1, wherein the filter housing includes one or more connectors to mount the filter housing onto an inner surface of the drum.

9. The lint filter of claim 1, wherein the filter housing includes an inner lip configured to receive a perimeter of the removable cover in an attached position.

10. The lint filter of claim 1, wherein the ribs are angled upward along the water flow direction to counteract the effect of gravity on the water flow.

11. The lint filter of claim 1, wherein the ribs are angled one or more of downward or horizontally along the water flow direction.

12. The lint filter of claim 1, wherein the ribs include notches to provide spacing for rotation of the retainer barrels within the chambers.

13. The lint filter of claim 1, wherein the plurality of filter chambers includes first and second chambers arranged adjacent to one another.

14. The lint filter of claim 13, wherein the plurality of filter chambers further includes a third chamber which extends the collective width of the first and second chambers.

15. The lint filter of claim 14, wherein the first and second chambers are configured to collectively hold approximately the same volume of water as the third chamber.

16. The lint filter of claim 14, wherein the third chamber is located above the first and second chambers.

17. The lint filter of claim 14, wherein the third chamber is located below the first and second chambers.

18. The lint filter of claim 14, wherein the barrels arranged in the first and second chambers are arranged in a direction opposite to those of the barrels arranged in the third chamber.

19. The lint filter of claim 14, wherein the at least one inlet includes:

a first side inlet open to the first chamber in a circumferential direction of the washing drum, allowing the wash water to flow into the first chamber;

a second side inlet, opposite the first side inlet, and open to the second chamber in an opposite circumferential direction of the washing drum, allowing the wash water to flow into the second chamber; and a third inlet opened in an axial direction of the drum, allowing the wash water to flow into the third chamber.

20. The lint filter of claim 1, wherein the filter housing includes a solid back face to prevent water from entering or leaving the filter at the back of the filter housing.

21. The lint filter of claim 1, wherein the filter housing is configured to snap into a corresponding connector on the interior of the drum.

22. A laundry appliance comprising:

a drum, and a standalone lint filter mounted to an internal side wall of the drum, the lint filter including a plurality of chambers, each chamber having a lateral inlet and an outlet open towards the interior of the drum, a removable porous cover to which a plurality of retainer barrels are mounted, such that when the cover is attached to the lint filter the retainer barrels fit into the plurality of chambers to trap lint, and when the cover is detached from the lint filter the retainer barrels allow for cleaning, and a plurality of ribs arranged in the chambers along the water flow direction to direct the water flow across the retainer barrels and out the cover.

23. The laundry appliance of claim 22, wherein the retainer barrels each include bristles or pins to trap the lint.

24. The laundry appliance of claim 23, wherein the ribs include notches to provide spacing for rotation of the retainer barrels within the chambers.

25. The laundry appliance of claim 22, wherein the retainer barrels are arranged normal to the water flow within the lint filter.

26. The laundry appliance of claim 22, wherein the plurality of chambers includes first and second chambers arranged adjacent to one another and above a third chamber which extends the collective width of the first and second chambers, and the inlets include:

a first side inlet open to the first chamber in a circumferential direction of the drum, allowing wash water to flow into the first chamber;

a second side inlet, opposite the first side inlet, and open to the second chamber in an opposite circumferential direction of the drum, allowing the wash water to flow into the second chamber; and a third inlet opened in an axial direction of the drum, allowing the wash water to flow into the third chamber.

27. A standalone drum-mounted lint filter for a washing machine, comprising:

a filter housing including a plurality of inner walls dividing the filter housing into a plurality of filter chambers, each filter chamber defining at least one inlet configured to allow wash water to flow into the respective chamber, wherein the plurality of filter chambers further includes first and second chambers arranged adjacent to one another and a third chamber which extends the collective width of the first and second chambers;

at least one retainer barrel arranged within each filter chamber and configured to retain lint during operation of the washing machine;

a porous removable filter cover defining front-facing outlets open to a washing drum of the washing machine, allowing for exit of the wash water back into the wash, wherein the at least one inlet includes a first side inlet open to the first chamber in a circumferential direction of the washing drum, allowing the wash water to flow into the first chamber;

a second side inlet, opposite the first side inlet, and open to the second chamber in an opposite circumferential direction of the washing drum, allowing the wash water to flow into the second chamber; and a third inlet opened in an axial direction of the drum, allowing the wash water to flow into the third chamber.

* * * * *